US006814435B1

(12) United States Patent
Shimada et al.

(10) Patent No.: US 6,814,435 B1
(45) Date of Patent: Nov. 9, 2004

(54) INK-JET RECORDING APPARATUS

(75) Inventors: Kazumichi Shimada, Nagano (JP); Hisashi Miyazawa, Nagano (JP); Takao Kobayashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/004,271

(22) Filed: Jan. 7, 1998

Related U.S. Application Data

(63) Continuation of application No. 08/628,348, filed on Apr. 5, 1996, now Pat. No. 6,019,465.

(30) Foreign Application Priority Data

| | | |
|---|---|---|
| Apr. 5, 1995 | (JP) | 7-104767 |
| Nov. 8, 1995 | (JP) | 7-314744 |
| Dec. 6, 1995 | (JP) | 7-344867 |
| Dec. 19, 1995 | (JP) | 7-349222 |
| Mar. 11, 1996 | (JP) | 8-82050 |

(51) Int. Cl.[7] ..... B41J 2/175
(52) U.S. Cl. ..... 347/93; 347/86
(58) Field of Search ..... 347/43, 85–87, 347/93; 346/46

(56) References Cited

U.S. PATENT DOCUMENTS

| | | | | |
|---|---|---|---|---|
| 4,447,820 A | | 5/1984 | Terasawa | 347/86 |
| 4,630,076 A | * | 12/1986 | Yoshimura | 347/43 |
| 4,672,432 A | * | 6/1987 | Sakurada et al. | 358/534 |
| 4,870,430 A | | 9/1989 | Daggett et al. | 347/88 |
| 5,103,246 A | * | 4/1992 | Dunn | 347/58 |
| 5,359,357 A | | 10/1994 | Takagi et al. | 347/49 |
| 5,523,780 A | | 6/1996 | Hirosawa et al. | 347/86 |
| 5,619,237 A | * | 4/1997 | Inoue et al. | 347/86 |
| 5,805,190 A | | 9/1998 | Tsuchii et al. | 347/100 |
| 6,019,465 A | * | 2/2000 | Shinada et al. | 347/93 |
| 6,145,974 A | | 11/2000 | Shinada et al. | |

FOREIGN PATENT DOCUMENTS

| | | | |
|---|---|---|---|
| DE | 3238732 A1 | | 4/1984 |
| DE | A13401071 | | 7/1985 |
| DE | A13424175 | | 1/1986 |
| EP | 0 379 151 A2 | | 7/1990 |
| EP | 0 388 978 A2 | | 9/1990 |
| EP | A20498293 | | 8/1992 |
| EP | 532 302 | * | 3/1993 |
| EP | 0 558 236 A2 | | 9/1993 |
| EP | A20574888 | | 12/1993 |
| EP | 0 623 471 A2 | | 11/1994 |
| EP | 627 323 | * | 12/1994 |
| EP | 0 639 462 A2 | | 2/1995 |
| EP | 0 645 244 A1 | | 3/1995 |
| EP | 0 664 218 A2 | | 7/1995 |
| EP | A20665108 | | 8/1995 |
| EP | A20683050 | | 11/1995 |
| EP | A20699532 | | 3/1996 |
| GB | 2 314 809 A | | 1/1998 |
| GB | 2 316 037 A | | 2/1998 |
| JP | 57-057566 | | 9/1955 |
| JP | 02281960 A | | 11/1990 |
| JP | A-6-015835 | | 1/1994 |
| JP | 7125262 | | 5/1995 |

OTHER PUBLICATIONS

Patent Abstracts of Japan, vol. 012, No. 289 (M–728), & JP 63–064750 A (Hitachi Ltd.), Mar. 23, 1988, *Abstract.

Patent Abstracts of Japan, vol. 010, No. 311 (M–528) & JP 61 121955 A (Ricoh Co., Ltd), Jun. 9, 1986 *Abstract.

* cited by examiner

*Primary Examiner*—Michael Nghiem
(74) *Attorney, Agent, or Firm*—Stroock & Stroock & Lavan LLP

(57) ABSTRACT

An ink cartridge which is used with an inkjet recording apparatus includes a plurality of ink storage chambers. A first of the storage chambers can store light cyan ink, a second can store deep cyan ink, a third can store light magenta ink, a fourth can store deep magenta ink, and a fifth can store yellow ink. The ink storage chambers can all be accommodated integrally in a single ink cartridge. In one embodiment of the invention, the ink storage chambers are partitioned by partitioning walls which gradually increase in thickness as they approach the portion of the ink chambers having supply ports therein.

12 Claims, 13 Drawing Sheets

INK-JET RECORDING APPARATUS

This is a continuation of application Ser. No. 08/628,348 filed Apr. 5, 1996 now U.S. Pat. No. 6,019,465.

BACKGROUND OF THE INVENTION

1. Field of the Invention

The present invention relates to an ink-jet recording apparatus which ejects ink droplets from nozzles to write a recording image such as characters on a recording medium, and more particularly to a structure of an ink supply channel for introducing ink from an ink storage tank to an ink-jet recording head.

2. Description of the Prior Art

An ink-jet recording apparatus which ejects ink droplets from nozzle openings to print characters and images on a recording medium is provided with a filter plate between an ink tank and a recording head in order to eliminate dust particles and bubbles in ink.

However, as the number of nozzles openings provided in a recording head is increased to 64 and further to 128 for improving the resolution of printed images to permit a larger amount of ink to flow from the ink tank to the recording head, larger head losses are induced by the filter plate for preventing foreign substances from flowing into the recording head, whereby supply of ink to the recording head cannot catch up with an amount of ink consumed for recording.

To solve the problem as mentioned above, the opening area of the filter plate need be increased to reduce a fluid resistance of the filter plate. However, this resolution would give rise to another problem of causing an uneven flow of ink through the filter plate, stagnated bubbles, and eventually a degraded printing quality.

SUMMARY OF THE INVENTION

The present invention has been made in view of the problems mentioned above, and its object is to provide an ink-jet recording apparatus which is capable of maximally reducing a channel resistance and of uniformly passing ink through a whole filter plate.

Another object of the present invention is to provide an ink-jet recording apparatus which is capable of reducing a mounting force required to mount a cartridge to the ink-jet recording apparatus.

To solve the problems mentioned above, the present invention provides an ink-jet recording apparatus comprises: an ink cartridge for storing ink; an inkjet recording head for ejecting the ink; an ink supply channel connecting the ink cartridge and the ink-jet recording head, the ink supply channel having a portion inclined in relation to the horizontal direction formed in the middle of the ink supply channel; and a filter plate placed so as to diagonally traverse the inclined portion.

DETAILED DESCRIPTION OF THE PREFERRED EMBODIMENTS

The present invention will hereinafter be described in connection with several embodiments thereof which are illustrated in detail in the accompanying drawings.

Figure 1:
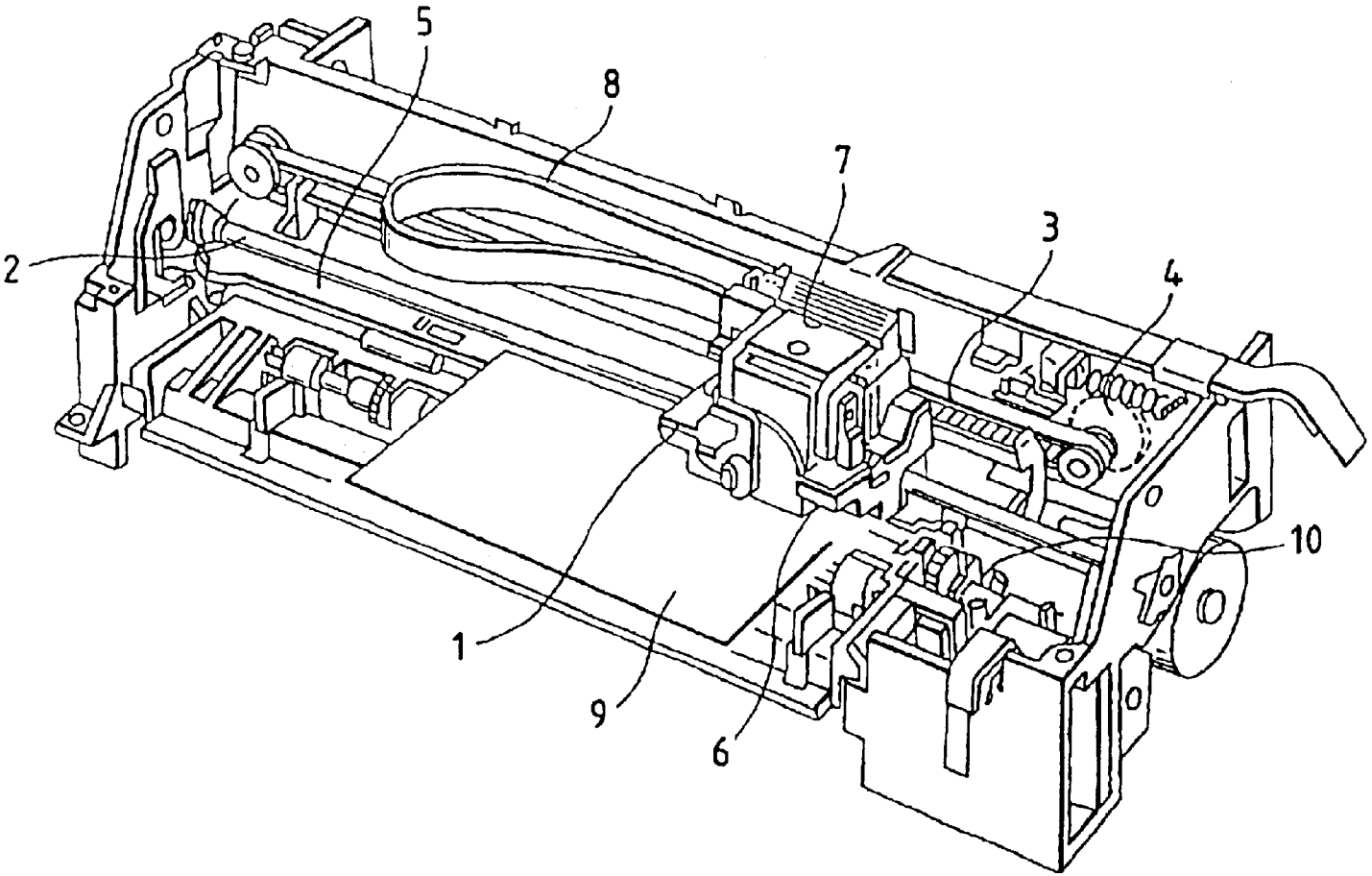
FIG. 1 is a diagram illustrating one embodiment of an ink-jet printer to which the present invention is applied.

FIG. 1 illustrates an ink-jet printer which is provided with an ink-jet head unit according to the present invention, wherein reference numeral 1 designates a carriage which is supported by a guide member 2, connected to a step motor 4 through a timing belt 3, and mounted for reciprocal movement in parallel with a platen 5.

The cartridge 1 is equipped with an ink-jet recording head 6, later described, removably mounted on its lower surface and a printing unit 7 also removably mounted on its upper surface. The recording head 6 is supplied with a driving signal through a flexible cable 8. Further, in the drawing, reference numeral 9 designates a recording sheet and 10 designates a capping means for sealing the recording head when printing is not performed.

Figure 2:
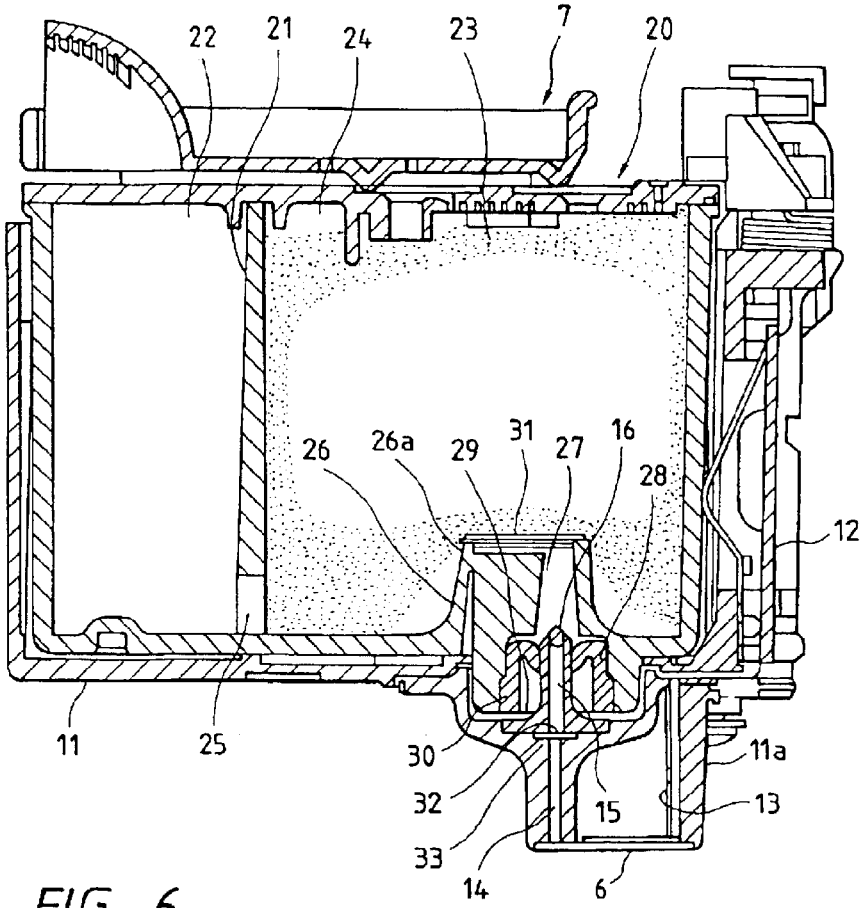
FIG. 2 is a cross-sectional view illustrating one embodiment of an ink supply channel connecting an ink cartridge with a recording head used in the printer of FIG. 1.

FIG. 2 illustrates one embodiment of the printing unit mentioned above which comprises a holder 11 mounted on the cartridge 1 and an ink cartridge 2 accommodated in the holder 11. The ink-jet recording head 6 is positioned on a surface of the holder 11 opposite to the recording sheet 9, i.e., on the lower surface in the embodiment.

The recording head 6 is connected through a flexible cable 13 to a terminal plate 12 which provides removable electrical connection with terminals, not shown, on the cartridge connected to the flexible cable 8 of the printer body.

An ink cartridge 20 has its inner space partitioned by a wall 21 into two regions, i.e., an ink chamber 22 for storing ink as it is and a foam chamber 24 filled with a porous foam material 23, such that these two chambers communicate with each other by way of a throughhole 25 bored through a lower portion of the wall 21.

On the bottom of the foam chamber 24, a protrusion 26 is formed for urging the bottom of the foam material 23, and a throughhole 27 is formed through the protrusion 26 for defining an ink supply channel. The protrusion 26 is further provided with a first filter plate 31 on the top thereof and with an ink supply port 28 for receiving an ink supply needle 16 on the bottom thereof, later described.

The holder 11 is provided with the ink supply needle 16 implanted on its bottom. The ink supply needle 16 has the tip formed in a needle shape to allow an insertion into a packing 30 through a seal 29 which seals the ink supply port 28 of the ink cartridge 20. Also, a lower end surface of the ink supply needle 16 is formed with a throughhole 15 connected to an ink channel 14 communicating with the recording head 6.

Figure 3A:
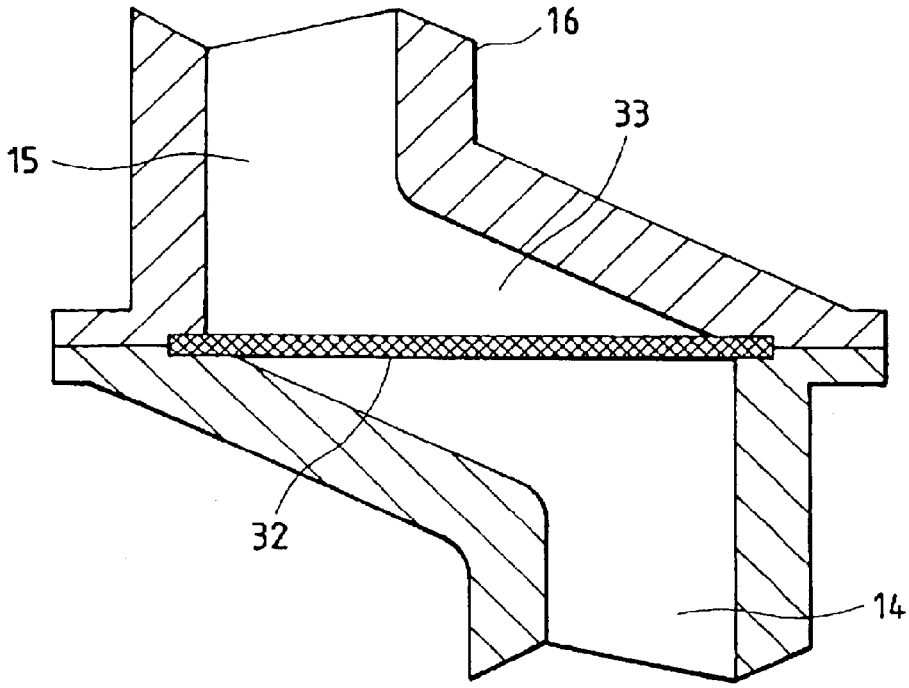
FIGS. 3(*a*) and 3(*b*) illustrate enlarged views of the vicinity of a second filter plate placed in an ink supply channel in the printer.
Figure 3B:
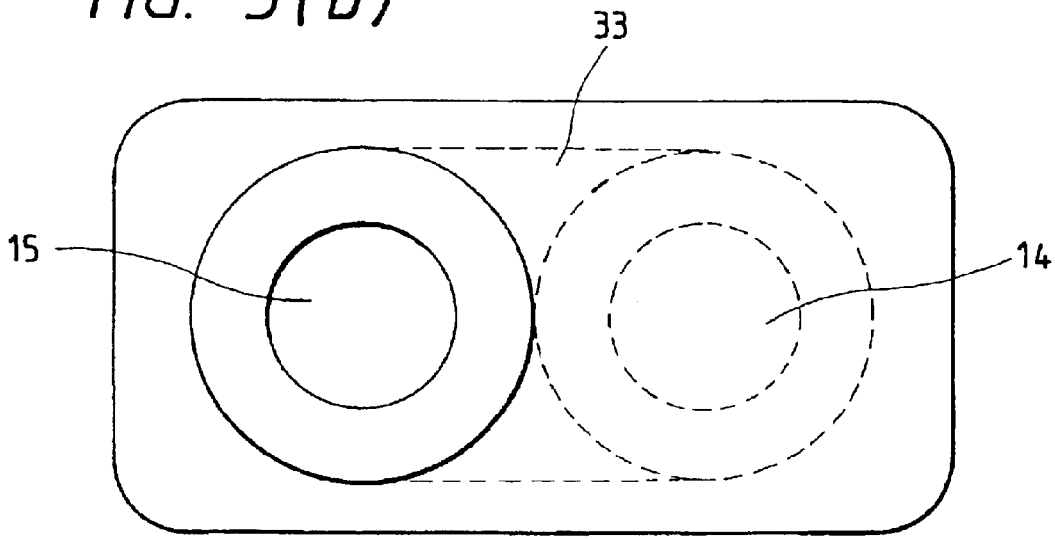

In this embodiment, a filter chamber 33 having a second filter plate 32 as illustrated in FIGS. 3(*a*) and 3(*b*) is formed between the lower end of the ink supply needle 16 and the throughhole 14 communicating with the recording head 6 in the middle of the ink supply channel as mentioned above.

The first filter plate 31 is formed of sintered unwoven fabrics 40, 41 made of stainless steel wires all having a diameter of approximately 5 μm, i.e., finer steel wires having a diameter 1/10 smaller than that of steel wires used for twilled filters. The firstfilter plate 31 is added to a mount 26*a* on the protrusion 26 so as to cover the throughhole 27 communicating with the ink supply port 13.

Among these unwoven fabrics 40, 41, the first unwoven fabric 40 located on the recording head 6 side is formed as an unwoven fabric which has a small thickness and a sufficiently high void ratio so as to provide a filter which has a small mesh size and a lowest possible channel resistance, in other words, a filter which exhibits a small dynamical pressure loss, i.e., a low channel resistance, when ink is supplied to the recording head, and a highest possible meniscus magnitude. The second unwoven fabric 41 laminated on the inside of the unwoven fabric 40 is formed as an unwoven fabric which, although a particularly high meniscus magnitude is not required, has a sufficient thickness to reinforce the first unwoven fabric 40 and a lowest possible channel resistance.

Figure 4A:
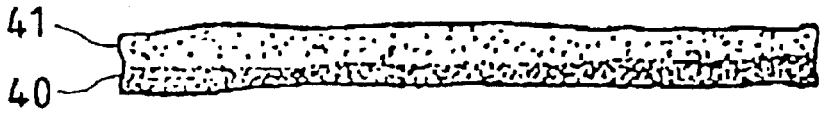
FIGS. 4(*a*) to 4(*c*) illustrate enlarged cross-sectional views of one embodiment of filter plates and an enlarged view of an unwoven fabric.
Figure 4B:
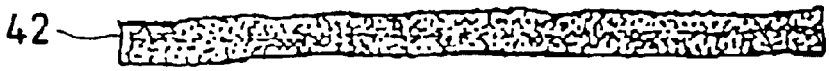
Figure 4C:
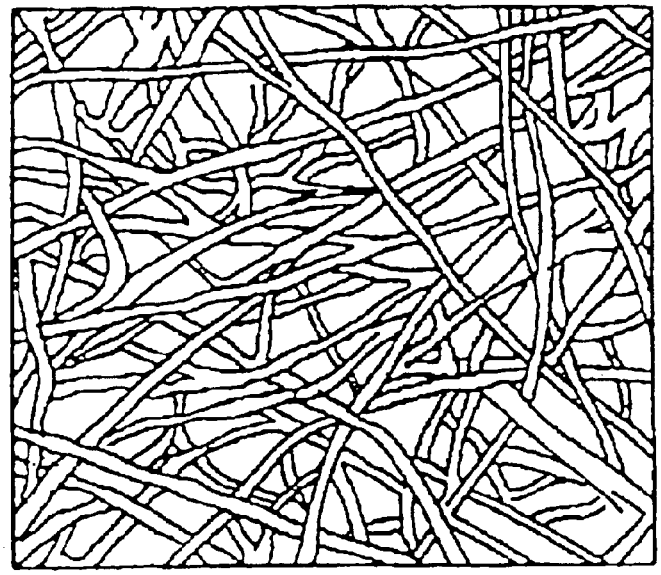

The second filter plate 32 placed to cover the throughhole 14 communicating with the recording head 6 is implemented by a sintered unwoven fabric made of stainless steel wires having a diameter of approximately 5 μm, as illustrated in FIG. 4(*b*), similarly to the first unwoven fabric 40 located on the ink cartridge 20 side.

The second filter plate 32 is formed as an unwoven fabric which has a small thickness and a sufficiently high void ratio so as to provide a filter which has a small mesh size and a lowest possible channel resistance, in other words, a filter which exhibits a small dynamical pressure loss, i.e., a low channel resistance, when ink is supplied to the recording head, and a highest possible meniscus magnitude.

Since the second filter plate 32 has one side protected by a head frame 11*a* of the recording head 6 and the other side protected by the ink supply needle 16, the second filter plate 32 does not require a reinforcement such as the unwoven fabric 41 for the first filter 31. However, the provision of a reinforcing unwoven fabric to the second filter plate 32, as the first filter plate 31, will enhance its shape retention, thus facilitating the mounting of the second filter plate 32.

As described above, the first filter plate 31 itself has a sufficient mechanical strength and hence the shape retention, so that it can be readily mounted. Moreover, since the first filter plate 31 has a high meniscus magnitude in comparison with its low channel resistance, it filters out solid particles and so on and does not allow bubbles to pass therethrough until ink held in the foam material 23 is almost used up during printing, so that ink can be smoothly supplied to the recording head 6.

While the foam material 23 is compressed by the protrusion 26 to enhance a capillary force near the protrusion 26, the foam material 23 may be pressed by providing the first filter plate 31 with a more sufficient mechanical strength.

The second filter plate 32, with its characteristic, i.e., a low channel resistance, allows ink supplied from the ink cartridge 20 to smoothly flow into the throughhole 14 on the nozzle side, while further filtering out solid particles remaining in the ink to eliminate clogging of the recording head 6.

In the embodiment, when ink is consumed by the recording head 6 for printing, ink absorbed in the foam material 23 in the cartridge 20 is drawn out by the recording head 6, flows into the ink supply needle 16 through the first filter plate 31 and the throughhole 27, and then flows into the filter chamber 33 by way of the ink supply channel 15.

Since the filter chamber 33 has a cross-sectional area substantially equal to the area of the ink supply port 15, ink flows into the recording head 6 through the throughhole 14 without decreasing the flow rate.

Since the second filter plate 32 is arranged to diagonally traverse the filter chamber 33, the filter plate 32 is ensured to have a sufficiently large opening area, so that it reduces a fluid resistance due to the filter plate 32 to a lowest possible value and accordingly suppresses a head loss. Also, since the filter plate 32 itself forms a high meniscus magnitude in comparison with a low channel resistance, it filters out solid particles and so on during printing, and does not permit bubbles to pass therethrough until ink held in the foam material 23 is almost used up, so that the ink is smoothly supplied to the recording head 6.

In addition, since ink flows substantially uniformly through the whole surface of the second filter plate 32, no stagnation will occur on the filter plate 32, and ink flows into the recording head 6 after dust particles and bubble included in the ink have been removed by the filter plate 32.

In some instances, an ink-jet recording head may be formed with a plurality of columns of nozzle openings, for improving the dot forming density, wherein each nozzle opening column is independently provided with a common ink chamber, and these nozzle opening columns are shifted by one-half of the pitch of the nozzle openings each other to form a staggered arrangement.

Figure 5:
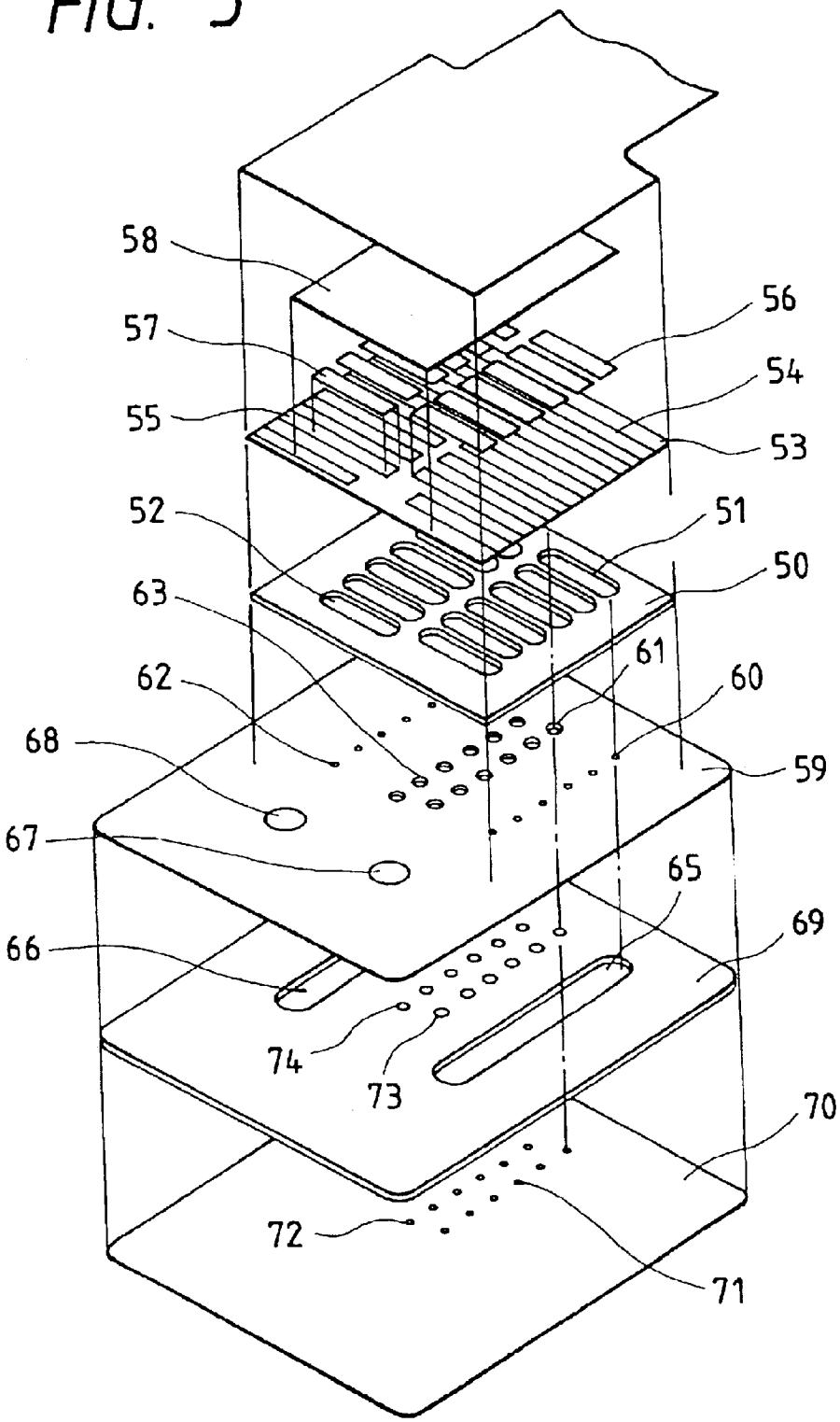
FIG. 5 is an exploded perspective view illustrating one embodiment of a recording head.

FIG. 5 illustrates one embodiment of an ink-jet recording head as mentioned above, wherein reference numeral 50 designates a pressure generating chamber forming board which is provided with two columns of pressure generating chambers 51, 52 and has one surface sealed by a vibration plate 53. The vibration plate 53 is provided on its surface with individually separated lower electrodes 54, 55 corresponding to the pressure generating chambers 51, 52. Piezo-electric vibrators 56, 57 are formed on the surfaces of the electrodes 54, 55, and an upper electrode 58 is formed overlying the plurality of piezo-electric vibrators 56, 57.

Reference numeral 59 designates a fixed board which has a function of fixing an actuator unit composed of the pressure generating chamber forming board 50 and the vibration plate 53 and a function as an ink supply port forming plate for receiving ink supplied from the outside. The fixed board 56 is also provided with communication holes 60, 61, 62, 63 communicating with the pressure generating chambers 51, 52 at both ends thereof, and with ink introducing ports 67, 68 for independently supplying ink to two common ink chambers 65, 66, later described.

Reference numeral 69 designates a common ink chamber forming plate which defines the common ink chambers 65, 66 for supplying ink from the ink introducing ports 67, 68 to each of the pressure generating chambers 51, 52 through the communication holes 60, 62. The ink chamber forming plate 69 has one surface sealed by the fixed board 59 and the other surface sealed by a nozzle plate 70. The nozzle plate 70 is provided with two columns of nozzle openings 71, 72 which communicate with the respective pressure generating chambers 51, 52 through communication holes 73, 74 of the common ink chamber forming plate 69 and the communication holes 61, 63 of the fixed board 59.

Figure 6:
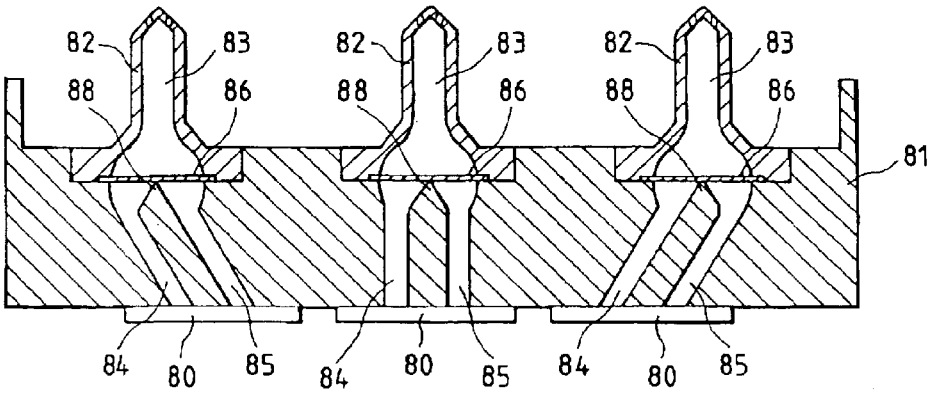
FIG. 6 is a cross-sectional view illustrating an embodiment of ink supply channels which are applied to the recording head of FIG. 5.

FIG. 6 illustrates one embodiment of a recording head for color printing which includes recording heads 80 as described above mounted on a common head frame 81. From an ink cartridge partitioned into a plurality of chambers for independently storing ink of their assigned colors, ink supply channels 83 of ink supply needles 82 to be inserted into recording heads 80 extend toward the recording heads 80.

A head frame 81 connected to the ink supply channels 63 of the ink supply needles 82 for supplying ink to the recording heads 80 is provided with a set of two throughholes 84, 85 such that ink can be independently supplied to two ink introducing ports 67, 68 of each recording head 80.

A filter chamber formed by a gradually expanding portion is located in a region communicating the ink supply channel 83 with the two throughholes 84, 85, and a second filter plate 86 is placed in the filter chamber.

Figure 7A:
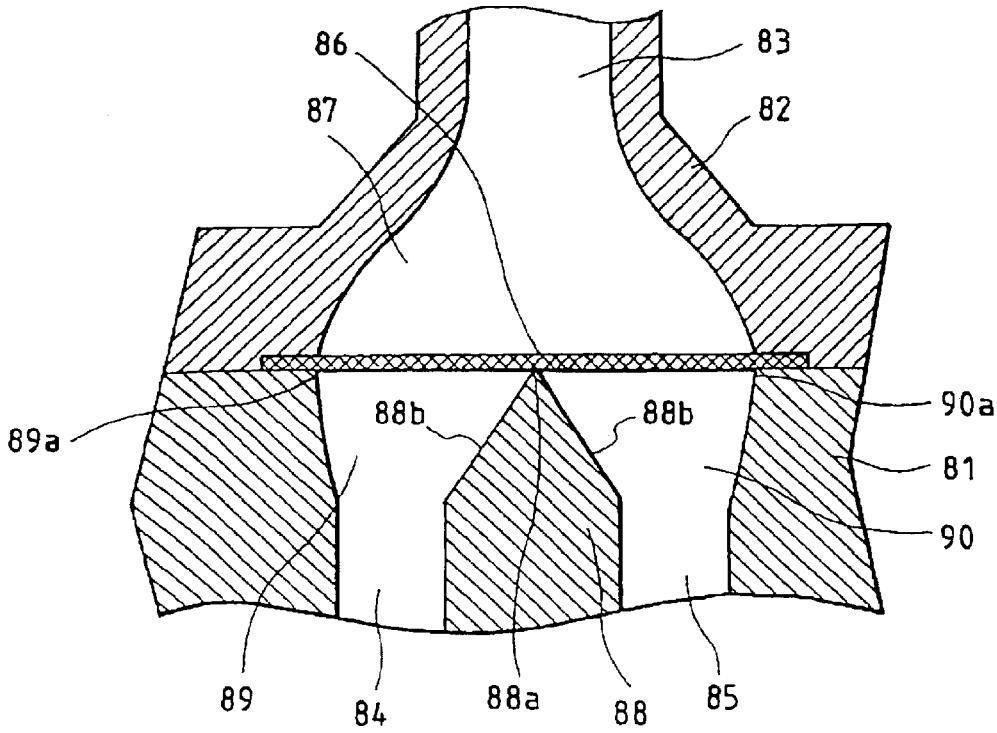
FIGS. 7(*a*) and 7(*b*) are a cross-sectional view illustrating in an enlarged view the vicinity of the filter plate in the ink supply channel shown in FIG. 6, and a top plan view illustrating the structure of a filter chamber on the holder side, respectively.
Figure 7B:
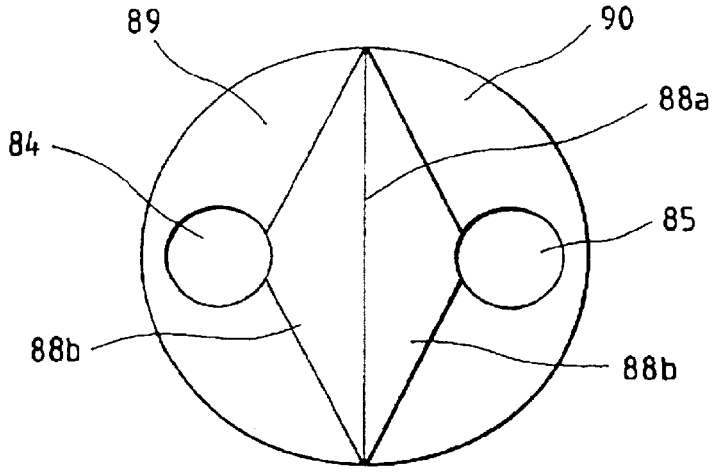

FIGS. 7(*a*) and 7(*b*) illustrate enlarged views of the vicinity in which the filter plate 86 is placed. A lower end portion of the ink supply channel 83 is substantially hemispherically expanded to form an upper half of the filter chamber 87. On the recording head side, a hemispherical recess having substantially the same shape as the outer periphery of the filter chamber 87 is partitioned into two filter chambers 89, 90 by a partition 88 having a ridge line 88*a* passing through the central point thereof. The two filter chambers 89, 90 are connected at their lower ends with throughholes 84, 85 extending to the recording head 80, respectively.

The throughholes 84, 85 are positioned such that they approach, in the horizontal direction, outside walls 89*a*, 90*a* at the upper ends of the filter chambers 89, 90. Stagnation is prevented from occurring on the outside walls of the filter chambers 89, 90.

The aforementioned second filter plate 86 is securely ad sandwiched by the ink supply needle 82 and the head frame 81 at the boundary between the upper filter chamber 87 and the lower filter chambers 89, 90, such that the filter plate 86 is in contact with the ridge line 88*a*.

According to the embodiment, since the upper filter chamber 87 is substantially hemispherically formed to provide a large volume of spacing near the filter plate 86, the recording head 80 can be supplied with ink without disturbing the ink flow even if bubbles or the like attach to the inner wall of the upper filter chamber 87.

In addition, since the throughholes 84, 85 are arranged close to the outside walls 89, 90 at the upper ends of the filter chambers 89, 90 in the horizontal direction, stagnation likely to occur in a curved portion is prevented. Also, in the centor portion, the conically formed partition 88 forces ink to flow along planar walls 88*b*, so that the recording head 80 can be smoothly supplied with ink, of course, without stagnation.

Figure 8A:
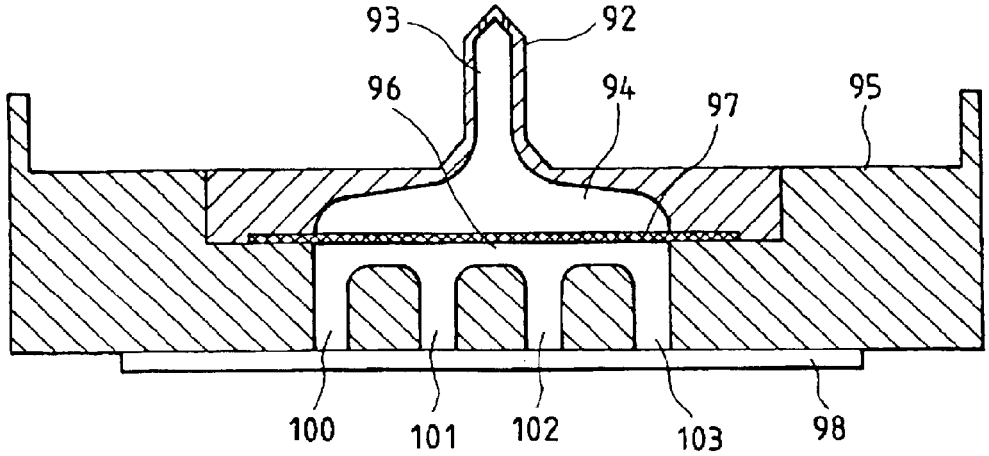
FIGS. 8(*a*) to 8(*c*) are a cross-sectional view illustrating one embodiment of ink supply channels suitable for supplying ink from a single ink supply needle to a number of common ink chambers, and a top plan view and a cross-sectional view illustrating the structure of a lower filter chamber.
Figure 8B:
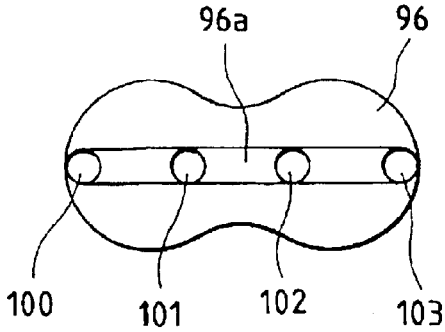
Figure 8C:
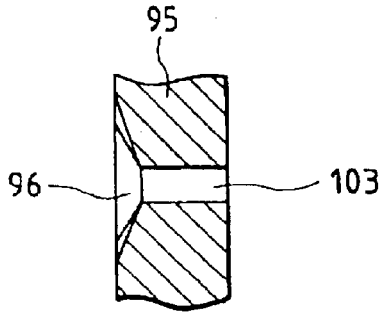

FIGS. 8(*a*) to 8(*c*) illustrate channels suitable for supplying ink from a single ink supply needle to four common ink chambers. An ink supply needle 92 is provided at its lower end with a filter chamber 94 smoothly expanding from an ink supply channel 93 in a cocoon shape. Also on the head frame side, a filter chamber 96 is formed in a cocoon shape having a narrowed central portion. A second filter plate 97 is placed on the boundary between these filter chambers 94, 96.

The lower filter chamber 96 communicates with upper ends of throughholes 100–103 for supplying ink which are formed in alignment with the positions of ink introducing ports 67, 68 of a recording head 98. Within the throughholes 100–103, the two throughholes 100, 103 located outside are positioned such that their outside walls are aligned with the wall surfaces of the filter chambers 94, 96. These throughholes 100–103 communicate with each other through a narrow groove 96*a*. In addition, unlike the embodiments 2*a* illustrated in FIGS. 6, 7, all of the throughholes 100–103 communicate in the filter chamber 96 with a fixed spacing ensured between the lower surface of the filter 97 and the respective throughholes 100–103.

According to the embodiment, even if unbalanced suction pressure occurs between four common ink chambers when ink is supplied from the single ink supply needle 92 to the four common ink chambers, a uniform pressure prevails in the whole filter chamber 96 since all the channels 100–103 communicate in the lower filter chamber 96 without intervention of the filter plate 97. Thus, ink can pass through the whole surface of the filter plate 97, and a pressure loss due to the filter plate 97 is reduced as much as possible. Furthermore, even if bubbles or the like attach to the filter plate 97, it is possible to avoid inconveniences such as disabled supply of ink to part of the common ink chambers.

In addition, since the filter chambers 94, 96 are formed in a cocoon shape so as to cover all the throughholes 100–103 and provided with large volumes as compared with the opening areas of the throughholes 100–103, even if bubbles are introduced into the filter chamber 94 formed in the ink supply needle 92 and the bubbles inflate therein, the filter chamber 94 can absorb the inflating bubbles with the large volume to maximally prevent the bubbles from attaching to the filter plate 97.

Further, since a portion immediately below the ink supply needle 92 is narrowed, the throughhole 100, 103 on both sides can also be supplied with ink in a well balanced manner. Furthermore, since the throughholes 100, 103 on both sides are formed such that the outside walls thereof are aligned with the end wall surfaces of the upper filter chamber 94, stagnated ink can be eliminated in end portions.

Further, since the lower surface of the filter plate 97 is not in contact with a partition for branching the respective channels 100–103, attachment of bubbles to the lower surface of the filter plate 97 can be prevented maximally.

Figure 9A:
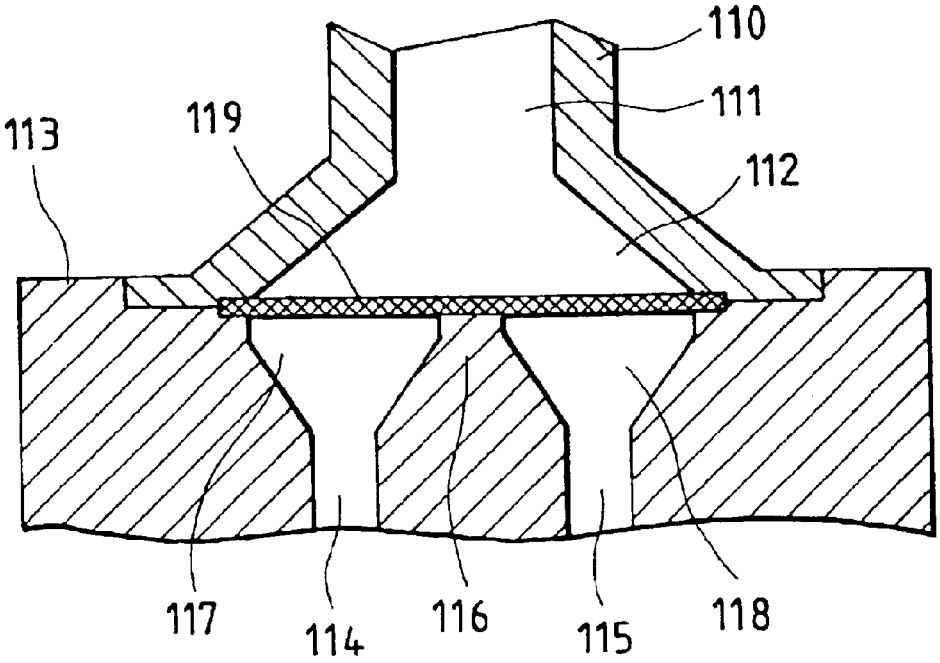
FIGS. 9(*a*) and 9(*b*) are a cross-sectional view illustrating another embodiment of the ink supply channels and a top plan view illustrating the structure of the channels on the filter chamber side.
Figure 9B:
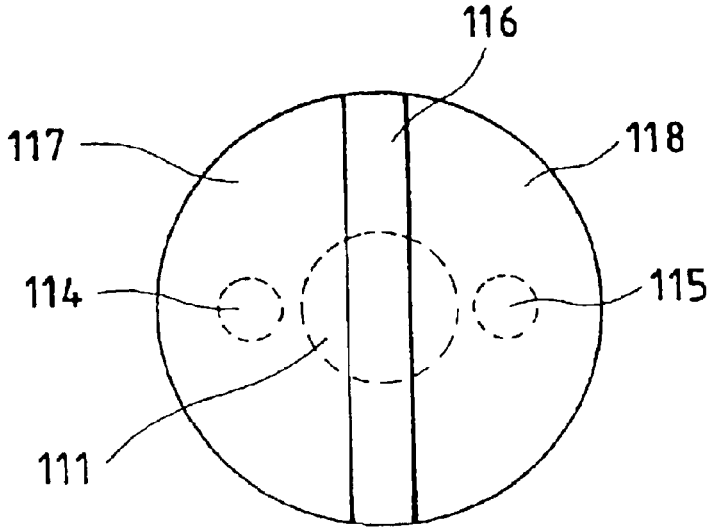

FIGS. 9(*a*) and 9(*b*) illustrate another embodiment of a structure for independently supplying ink from a single ink supply needle to two common ink chambers. An ink channel 111 of an ink supply needle 110 is formed at its lower end with a funnel-shaped filter chamber 112 gradually expanding toward the recording head side. A head frame 113 is provided with throughholes 114, 115 which communicate with respective common ink chambers of a recording head. The upper ends of the throughholes 114, 115 are partitioned by a partition 116 and connected to filter chambers 117, 118 gradually expanding toward the ink supply needle side, and a second filter plate 119 is placed to be in contact with the partition 116.

In this embodiment, ink flowing from an ink cartridge into the ink supply needle 110 is once accumulated in the funnel-shaped filter chamber 112, passes through the filter plate 119 facing the filter chamber 112 to the lower filter chambers 117, 118, and flows into the recording head through the throughholes 114, 115.

The filter chamber 112 is formed in a funnel shape to have a gradually larger cross-sectional area, and the lower filter chambers 117, 118 receiving ink from the filter chamber 112 are separately defined, so that ink flows through these chambers without stagnation. In addition, since the filter plate 119 having a large cross-sectional area is placed on the boundary of these filter chambers, a head loss is reduced.

Figure 10:
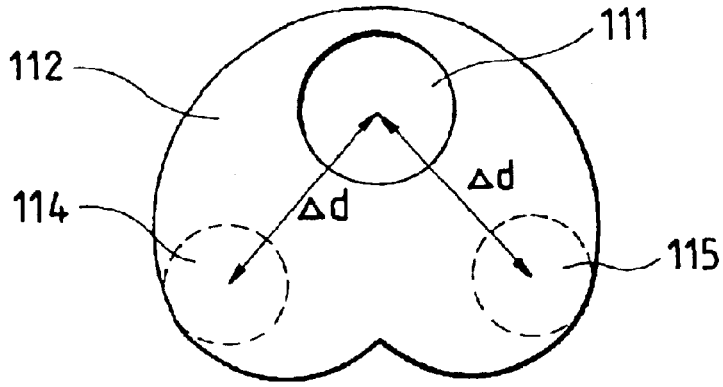
FIG. 10 is a diagram illustrating another embodiment of the channel structure in a positional relationship between an ink supply needle and throughholes communicating with a recording head to form ink channels.

While in the foregoing embodiment, an inflow port and an outflow port are positioned on the same line, the throughholes 114, 115 communicating with the recording head may be offset from the central axis of the ink supply needle 110 by a fixed amount Ad in the horizontal direction, as illustrated in FIG. 10, to have ink flow down diagonally relative to the filter plate 119. In this way, the ink passes through a larger area of the filter plate 119 so that a head loss due to the filter plate 119 can be reduced.

Figure 11:
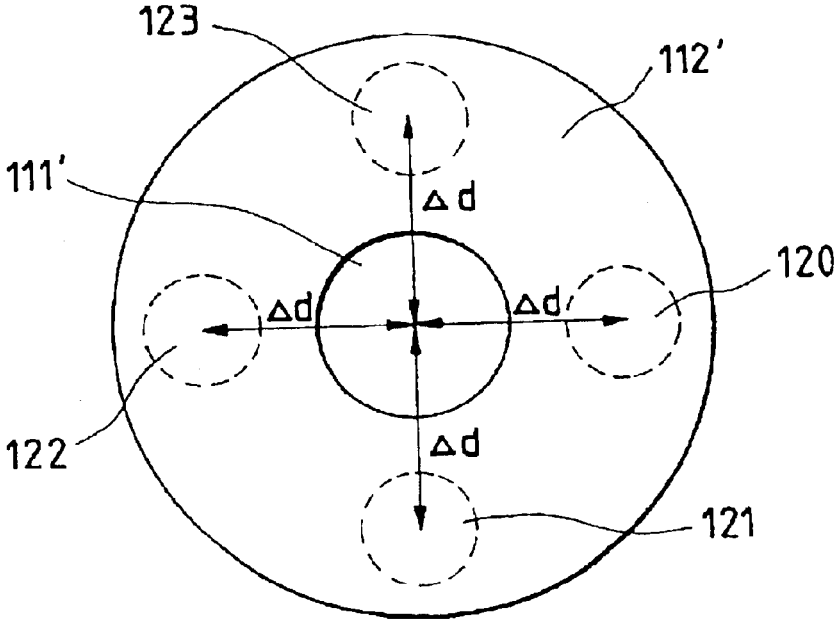
FIG. 11 is a diagram illustrating another embodiment of the channel structure in a positional relationship between an ink supply needle and throughholes communicating with a recording head to form ink channels.
Figure 12A:
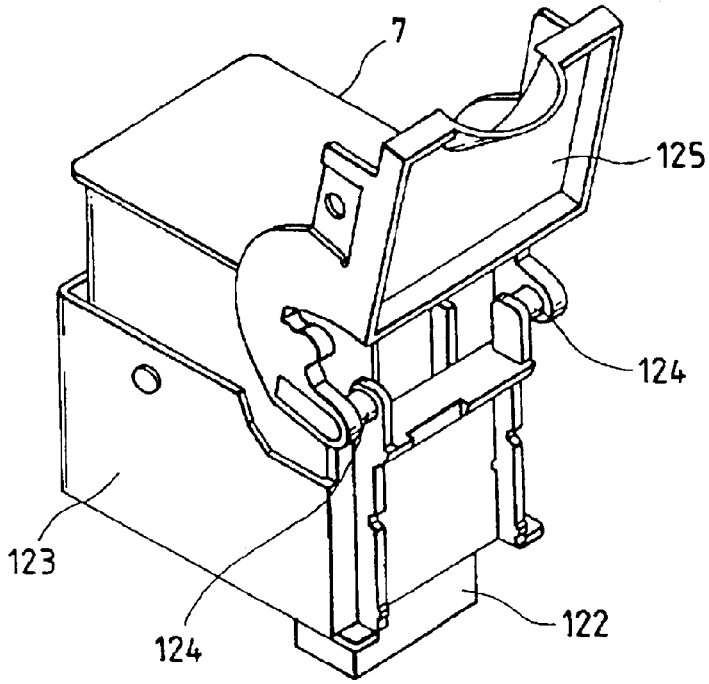
FIGS. 12(*a*) and 12(*b*) are a perspective view and a cross-sectional view respectively illustrating the structure in the vicinity of a cartridge holder and a recording head, removed from a carriage, in a recording apparatus using light and deep color ink.
Figure 12B:
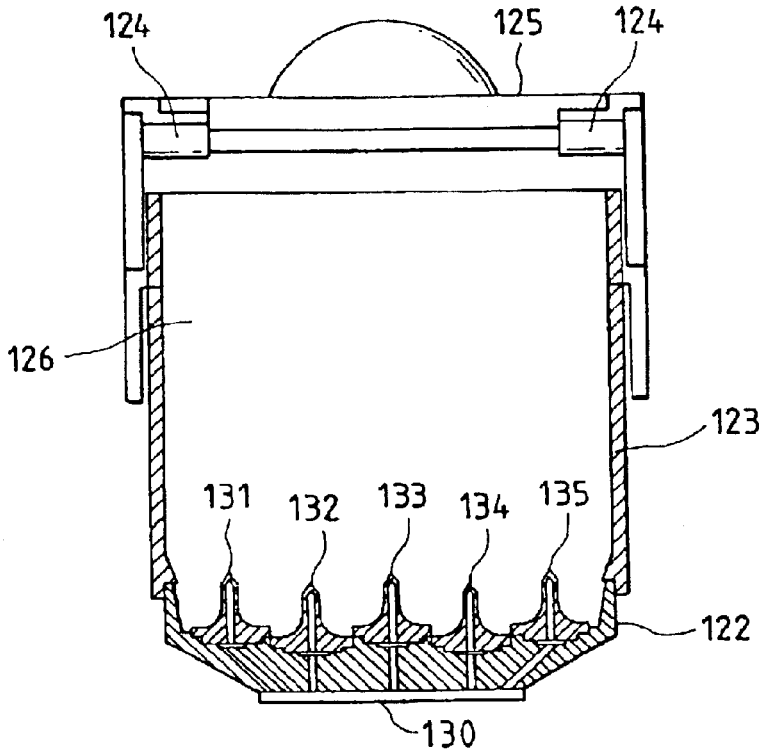

Also, in the foregoing embodiment, the lower filter chambers are formed. Alternatively, as illustrated in FIG. 11, three or more throughholes 120, 121, 122, 123 may be equally offset from the central axis by a fixed amount Ad so as to be positioned along the outer periphery of an ink supply needle, such that the respective throughholes 120, 121, 122, 123 are connected to individual ink introducing ports of a recording head, or they are joined to be connected to a single ink introducing port of a recording head. It will be apparent that the latter structure also provides similar actions.

For accomplishing a further improvement in the quality of color prints produced by an ink-jet printer, the recording head 6 may be implemented by such one that is capable of independently ejecting ink of five colors including light cyan, deep cyan, light magenta, deep magenta, and yellow. It should be noted that since yellow is essentially a light color and the provision of two different types of yellow color, i.e., light and deep would not result in remarkable effects, only deep yellow is generally used.

Figure 15A:
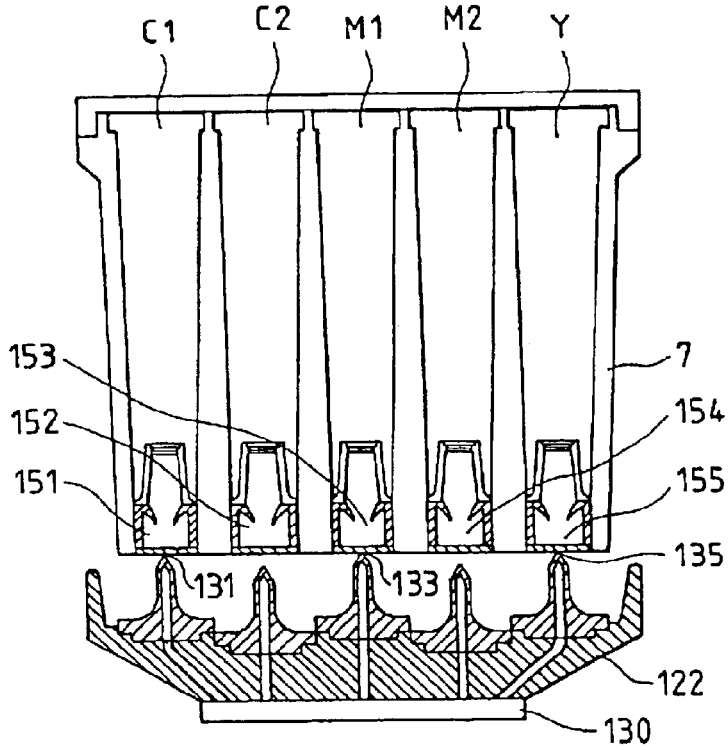
FIGS. 15(*a*) and 15(*b*) are diagrams respectively illustrating a state in which an ink cartridge is being mounted.
Figure 15B:
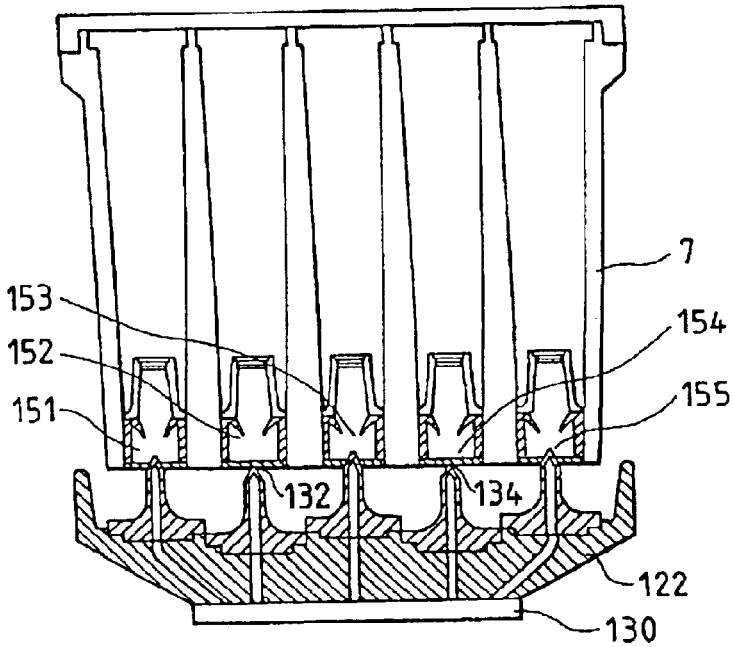

Correspondingly, a head frame 122 on which a recording head 130 of the type mentioned above is fixed is provided with a cartridge holder 123 which carries an ink cartridge 7 (FIGS. 15(*a*) and 15(*b*)) having storage chambers C1, C2, M1, M2, Y for storing ink of the five difference colors, respectively.

On an upper end side of the cartridge holder 123, a lid 125 is arranged for pivotal movement about shafts 124. When an ink cartridge 7 is dropped into a cartridge chamber 126 and the lid 125 is pivoted downwardly with the ink cartridge 7 accommodated in the cartridge chamber 126, ink supply needles 131, 132, 133, 134, 135 can be inserted into the ink cartridge 7. Conversely, by lifting up the lid 125, the cartridge 7 can be removed from the cartridge chamber 126.

Figure 13A:
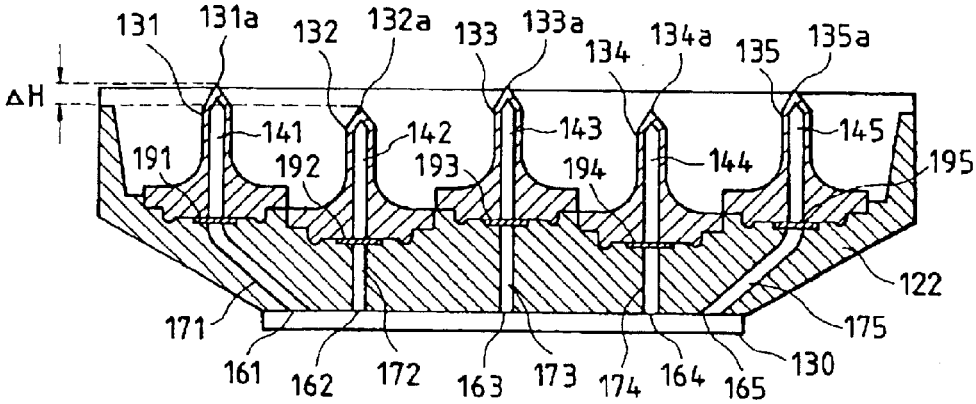
FIGS. 13(*a*) and 13(*b*) are a cross-sectional view illustrating the structure of the head frame and a top plan view of the same except for ink supply needles.
Figure 13B:
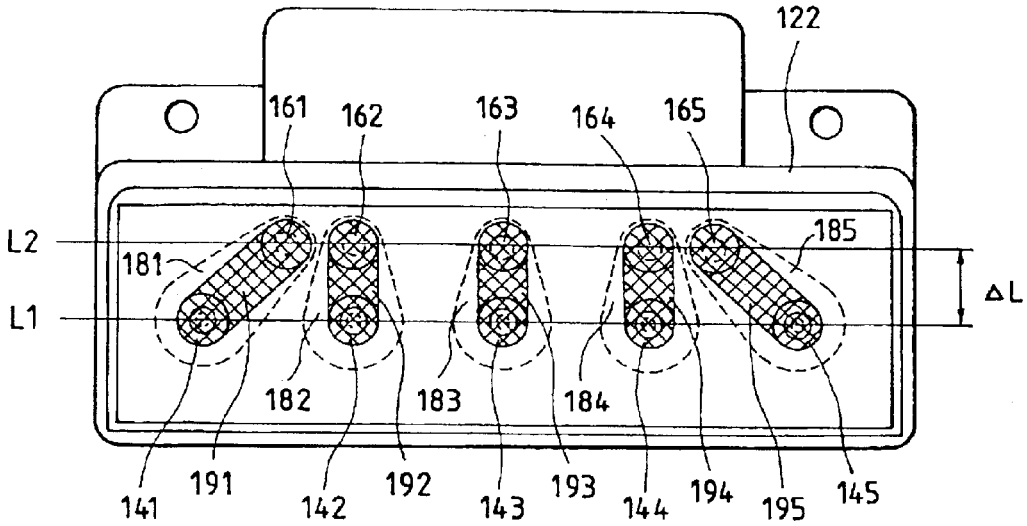

FIGS. 13(*a*) and 13(*b*) illustrate one embodiment of ink supply channels formed in the above-mentioned head frame 122, wherein reference numerals 131, 132, 133, 134, 135 designate ink supply needles having the same configuration which are fixed on the head frame 122 in a liquid tight structure. The ink supply needles are aligned on a straight line L1 with a fixed interval L therebetween so as to face ink supply ports 151, 152, 153, 154, 155 (FIG. 15) of the ink cartridge 7, respectively, Also, the ink supply needles are mounted on the head frame 122 at alternate heights so that the positions of adjacent tips 131*a*, 132*a*, 133*a*, 134*a*, 135*a* are offset by a height difference ΔH.

The recording head 130 has ink introducing ports 161, 162, 163, 164, 165 aligned on the same straight line L2 which are capable of independently receiving ink of corresponding colors supplied thereto. The recording head 130 is fixed on the head frame 122 such that the straight line L2 is offset by a slight distance AL from the straight line L1 on which the ink supply needles 131, 132, 133, 134, 135 are aligned.

Figure 14A:
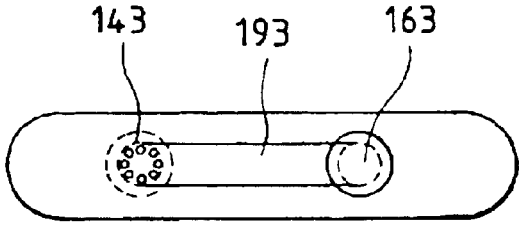
FIGS. 14(*a*) and 14(*b*) are a top plan view and a cross-sectional view of a channel, taken as an example, illustrating one embodiment of a channel which connects an ink supply needle to an ink introducing port of a recording head.
Figure 14B:
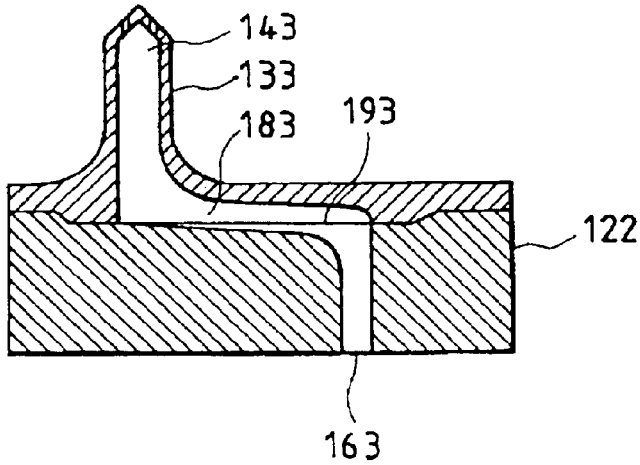

The head frame 122 is provided with throughholes 171, 172, 173, 174, 175 from positions opposite to the ink introducing ports 161, 162, 163, 164, 165 of the recording head 130 so as to ensure a length ΔL or more extending horizontally in parallel with the ink supply needles 131, 132, 133, 134, 135. For example, taking the ink introducing port 143 as an example, the channel from the ink supply needle 133 to the throughhole 173 extends substantially in the horizontal direction, however, directs slightly downwardly toward the ink introducing port 163, and is connected to the ink introducing port 163 through a horizontal filter chamber 183 having a width substantially equal to the diameter of the ink supply needle 133, as illustrated in FIGS. 14(*a*) and 14(*b*).

In respective filter chambers 181, 182, 183, 184, 185, second filter plates 191, 192, 193, 194, 195 are securely sandwiched between the head frame 122 and the ink supply needles 131, 132, 133, 134, 135, respectively, to extend in the horizontal direction.

In the embodiment, when an ink cartridge 7 is inserted into a cartridge chamber 126 and a lid 125 is pivoted downwardly, the ink cartridge 7 is lowered so that the ink supply ports 151, 153, 155 come into contact with the ink supply needles 131, 133, 135, the tips of which protrude by ΔH from the ink supply needles 132, 134 (FIG. 15(*a*)).

When the lid 125 is further pivoted downwardly from the state mentioned above to push the ink cartridge 7 into the cartridge chamber 126, the ink supply needles 131, 133, 135 only are inserted into the ink supply ports 151, 153, 155 of the ink cartridge 7. Then, the ink supply needles 132, 134 positioned lower than the ink supply needles 131, 133, 135 come into contact with the ink supply ports 152, 154, respectively (FIG. 15(*b*)).

In the stated illustrated in FIG. 15(*b*), since the ink supply needles 131, 132, 135 have already been inserted in the ink supply ports 151, 153, 155, respectively, so that a relatively small force is only required to insert all the ink supply needles 131–135 into the ink supply ports 151–155.

With the ink cartridge 7 mounted on the recording head 130, when the recording head 130 is sealed by a cap 10 and a negative pressure is applied to nozzle openings of the recording head 130, ink stored in the respective storage chambers C1, C2, M1, M2, Y of the ink cartridge 7 flows from the ink supply needles 131–135 into the recording head 130 through the filter chambers 181–185.

The channels connecting the ink cartridge 7 to the recording head 130 are partially constituted of the horizontal filter chambers 181–185 which extend substantially in the horizontal direction and have a width substantially equal to the diameter of the ink supply needles 131–135, and the filter plates 191–195 are placed in the respective filter chambers 181–185 so as to diagonally traverse the ink channels, so that the cross-sectional area of the filter plates 191–195 can be made large as compared with the cross-sectional area of the channels, whereby a stagnated ink flow can be eliminated in the channels and the channel resistance can be reduced, thereby making it possible to promptly remove bubbles and smoothly supply ink to the recording head 130.

In the present invention as described above, the channel resistance can be made as uniform as possible even if variations are present in the lengths of the channels connecting the ink supply needles 131–135 to the ink introducing ports 161–165 of the recording head 130, thereby making it possible to increase the freedom in designing the recording head and the ink cartridge, i.e., providing a reduced size of the recording head, a larger ink cartridge, and so on.

Figure 16:
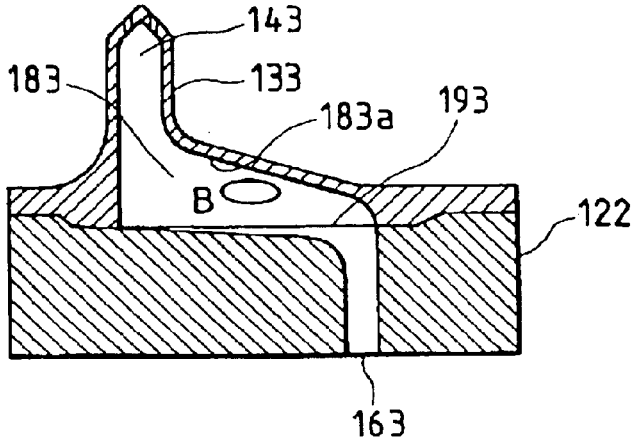
FIG. 16 is a cross-sectional view of a channel, taken as an example, illustrating another embodiment of a channel which connects an ink supply needle to an ink introducing port of a recording head

FIG. 16 illustrates another embodiment of the present invention in a channel, taken as an example, wherein a filter chamber 183 communicating an ink supply needle 133 with a throughhole 173 formed in the head frame 173 has an upper wall 183*a* above a filter plate 193 inclined upwardly toward the ink supply needle 133 and is partitioned into upper and lower spaces by the filter plate 193 such that the volume of the upper space above the filter plate 193 is larger than the volume of the lower space under the same.

According to this embodiment, even if a bubble B having introduced into the ink supply needle 133, for example, during exchanging a cartridge, is expanded due to a temperature rise or the like, the bubble B can be held above the filter plate 193 and moved upwardly along the inclined wall 183*a* of the filter chamber 183, thereby preventing the bubble B from attaching to the filter plate 83.

It will be apparent that while the foregoing embodiments are structured such that the ink cartridge is removed by moving it in the vertical direction, similar actions can also be made when the present invention is applied to a structure in which the ink cartridge is removed by moving it in the horizontal direction.

It will be also apparent that while the foregoing embodiments have been described in connection with a recording head using a single cartridge for storing ink of five colors, by way of example, similar actions can also be made when the present invention is applied to a recording head using a cartridge for storing ink of six colors or separate cartridges for independently storing ink of three light colors and ink of three deep colors, respectively.

It will be further apparent that while the foregoing embodiments have been described in connection with a recording head fixed on a cartridge, by way of example, similar actions can also be made when the present invention is applied to an add-on type which has a cartridge holder removably mounted on a carriage and a recording head arranged in the cartridge holder.

In the present invention as described above, a horizontally inclined filter chamber is formed in part of an ink supply channel having one end connected to an ink supply source and the other end connected to an ink-jet recording head and provided with a filter plate in the middle thereof, and the filter plate is placed to obliquely traverse the filter chamber, so that ink can flow substantially uniformly over the whole cross-sectional area of the ink channel. It is therefore possible to prevent bubbles from stagnating in the channel, increase an effective area of the filter plate to reduce the channel resistance, and accordingly decrease a head loss.

What is claimed is:

1. An ink cartridge which is used for an ink-jet recording apparatus, comprising:

a plurality of ink storage chambers storing ink of five different colors, all of the ink storage chambers being collectively integrally formed in the ink cartridge;

wherein different chambers of the five different colors are adjacent to each other;

wherein the ink storage chambers store light cyan ink, deep cyan ink, light magenta ink, deep magenta ink and yellow ink; and wherein each ink storage chamber has an ink supply port, and all ink supply ports are aligned on one straight line;

wherein the ink storage chambers are partitioned by partitioning walls and have supply ports constructed to supply ink, the partitioning walls having a first end and a second end, the second end being nearer the ink supply ports of each of said ink storage chambers, the partitioning walls being formed so that a thickness of the partitioning walls gradually increases from the first end to the second end, whereby the second end is thicker than the first end.

2. An ink cartridge which is used for an ink-jet recording apparatus, comprising:

a plurality of ink storage chambers, said plurality consisting of exactly five ink storage chambers, storing ink of exactly five different colors, all of the ink storage chambers being collectively integrally formed in the ink cartridge;

wherein different chambers of the five different colors are adjacent to each other;

wherein none of the ink storage chambers store black ink;

wherein the ink storage chambers store light cyan ink, deep cyan ink, light magenta ink, deep magenta ink and yellow ink; and wherein each ink storage chamber has an ink supply port, and all ink supply ports are aligned on one straight line.

3. The ink cartridge according to claim 2, wherein the yellow ink is stored in the ink storage chamber located at the most end side of the ink storage chambers.

4. The ink cartridge according to claim 2, wherein the light cyan ink, deep cyan ink, light magenta ink, deep magenta ink and yellow ink are stored in such a manner that similar colors are adjacent to each other.

5. The ink cartridge according to claim 2, wherein the ink storage chambers are arranged in an order of storing the light cyan ink, deep cyan ink, light magenta ink, deep magenta ink and yellow ink in a horizontal direction.

6. The ink cartridge according to claim 2, wherein all of said ink supply ports are arranged in one horizontal plain.

7. The ink cartridge of claim 2, wherein the ink storage chambers storing the deep cyan ink and light cyan ink are adjacent and the ink storage chambers storing the deep magenta ink and the light magenta ink are adjacent.

8. The ink cartridge according to claim 2, wherein a first chamber of said ink storage chambers storing a light cyan ink, a second chamber of said ink storage chambers storing a deep cyan ink, a third chamber of said ink storage chambers storing a light magenta ink, a fourth chamber of said ink storage chambers storing a deep magenta ink and a fifth chamber of said ink storage chambers storing a yellow ink.

9. The ink cartridge according to claim 2, wherein all of said ink supply ports are disposed at a bottom of said ink cartridge when said ink cartridge is positioned within the ink-jet recording apparatus.

10. The ink cartridge according to claim 2, wherein the ink storage chambers are partitioned by partitioning walls and have supply ports constructed to supply ink, the partitioning walls having a first end and a second end, the second end being nearer the ink supply ports of each of said ink storage chambers, the partitioning walls being formed so that a thickness of the partitioning walls gradually increases from the first end to the second end, whereby the second end in thicker than the first end.

11. The ink cartridge according to claim 2, wherein said ink cartridge is mounted on an ink-jet recording apparatus and storing ink of a plurality of colors to be supplied to the ink-jet recording apparatus which has an ink-jet recording head for ejecting the ink and a plurality of ink supply needles for supplying the ink to the recording head, adjacent ones of said ink supply needles being arranged to have height difference therebetween, the ink cartridge including:

a first chamber of said ink storage chambers storing a light cyan ink, a second chamber of said ink storage chambers storing a deep cyan ink, a third chamber of said ink storage chambers storing a light magenta ink, a fourth chamber of said ink storage chambers storing a deep magenta ink and a fifth chamber of said ink storage chambers storing a yellow ink, the ink storage chambers being integrally formed in the ink cartridge; and wherein the ink supply ports engage with the ink supply needles so as to supply the ink stored in the ink storage chambers to the ink supply needles.

12. An ink cartridge which is used for an ink-jet recording apparatus comprising:

a plurality of ink storage chambers storing ink of five different colors, all of the ink storage chambers being collectively integrally formed in the ink cartridge:

wherein different chambers of the five different colors are adjacent to each other;

wherein the ink storage chambers store light cyan ink, deep cyan ink, light magenta ink, deep magenta ink and yellow ink; and wherein each ink storage chamber has an ink supply port, and all ink supply ports are aligned on one straight line;

wherein said ink cartridge is mounted on an ink-jet recording apparatus and storing ink of a plurality of colors to be supplied to the ink-jet recording apparatus which has an ink-jet recording head for ejecting the ink and a plurality of ink supply needles for supplying the ink to the recording head, adjacent ones of said ink supply needles being arranged to have height difference therebetween, the ink cartridge including:

wherein a first chamber of said ink storage chambers storing a light cyan ink, a second chamber of said ink storage chambers storing a deep cyan ink, a third chamber of said ink storage chambers storing a light magenta ink, a fourth chamber of said ink storage chambers storing a deep magenta ink and a fifth chamber of said ink storage chambers storing a yellow ink, the ink storage chambers being integrally formed in the ink cartridge; and wherein the ink supply ports engage with the ink supply needles so as to supply the ink stored in the ink storage chambers to the ink supply needles.

* * * * *